United States Patent [19]

Koch

[11] 4,393,520

[45] Jul. 19, 1983

[54] ELBOW PILLOW

[76] Inventor: Coral A. Koch, 2067 W. Rainbow Ridge, Tucson, Ariz. 85745

[21] Appl. No.: 345,026

[22] Filed: Feb. 1, 1982

[51] Int. Cl.[3] ..... A41D 13/08

[52] U.S. Cl. ..... 2/16

[58] Field of Search ..... 2/16, 17, 59, 66; 5/436, 443, 325, 337; 128/165, 132 R; D6/206

[56] References Cited

U.S. PATENT DOCUMENTS

| | | | |
|---|---|---|---|
| 830,103 | 9/1906 | Randell | 5/443 |
| 2,765,480 | 10/1956 | Mueller | 5/443 |
| 2,961,668 | 11/1960 | Hayes | 5/436 |
| 3,446,880 | 5/1969 | Enicks | 2/16 |
| 4,120,052 | 10/1978 | Butler | 2/16 |

*Primary Examiner*—Doris L. Troutman

*Attorney, Agent, or Firm*—Cahill, Sutton & Thomas

[57] ABSTRACT

An elbow pillow adapted to be worn in the crook of a person's elbow for cradling a baby or other object comprising a pair of joined together pillows filled with compressible padding materials, each of said pillows having attached an elastic strap adapted to encompass the arm of the person and thereby secure the pillow in place on the person's arm.

5 Claims, 5 Drawing Figures

ELBOW PILLOW

BACKGROUND OF THE INVENTION

As is well known, mothers have cradled and carried babies in their arms since time immemorial. This is occasioned when the mother wishes to bed the child, carry the child, or even rock the child to sleep. However, less well known is the fact that as result of carrying the child in the cradling position in the crook of a mother's arm, the mother's arm will fast tire and, in addition in many cases, cut off the blood flow through that portion of the arm causing the arm to fall asleep and in general exhibit extreme tiredness or soreness in the arm.

Now many devices have been utilized to buffer the baby and the arm coming together, such as wrapping the child in a blanket, or laying a blanket across the mother's arm, or perhaps even carrying the baby in a mechanical cradle in the crook of the mother's arm. All of these methods have a place and time, but in many cases, for various reasons, it is not desired that the baby be wrapped in a blanket, or that a blanket be wrapped around the mother's arm, or that the child should reside in a cradle while the mnother is holding the cradle.

To this end, it would be advantageous to provide persons with a device designed especially to provide a comforting buffer between the area of the arm and the child where the two come together when the mother or other person cradling or holding a child or other object in the crook of the arm.

SUMMARY OF THE INVENTION

The subject invention defines a means by which a mother or other person can utilize a mechanism to provide a cushion or a pillow between the mother and the child in order for the mother to hold the child comfortably, both for the child and the mother, while cradling the child in the mother's arms. To this end, an invention has been devised consisting of two padding material filled pillows adapted to be worn on the mother's elbow. The two pillows are joined along a central line in order to provide an easy folding mechanism whereby the pillows will conform generally to each side of the elbow along the inside crook portion of the arm. To each of the pillows is fastened an elastic strap which encompasses each side of the mother's elbow to secure the elbow pillow in place.

It is an object of the subject invention to provide a means for a person to carry an object such as a child in the elbow crook of their arm.

It is another object of the invention to provide padded fitted means in the elbow crook of the person's arm in order to comfortably hold a child or other object therein.

It is still further an object of the subject invention to provide a means for holding a baby in the crook of a person's arm and securing the holding means to the person's arm.

DETAILED DESCRIPTION OF THE PREFERRED EMBODIMENT

Figure 1:
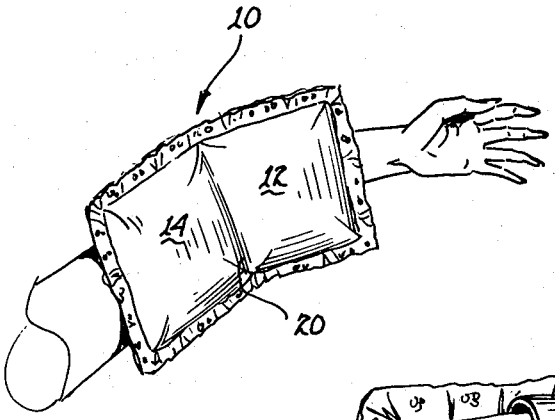
FIG. 1 is a perspective view of the subject invention in place upon a person's arm.

Referring now to FIG. 1, a perspective view of the subject inventive elbow pillow 10 is shown. Here is seen in position proximate the left elbow of a person, nested in the crook of the elbow the two pillows 12 and 14, each with their broad face in position to receive whatever object is desired to be held. As shown by the lines indicating the curve surface area near the outside borders of the pillow, it can be appreciated that the pillows will be filled with soft compressible material such as cotton or padding, protruding generally upward in the central area and rolling off to the seam at the perimeter of each pillow. Also illustrated is the central seam 20 line running transverse to the elongated direction of the two pillows and about which seam line folding or bending of the two pillows is permitted to conform to the changing angle formed by the arm at the elbow crook.

Figure 2:
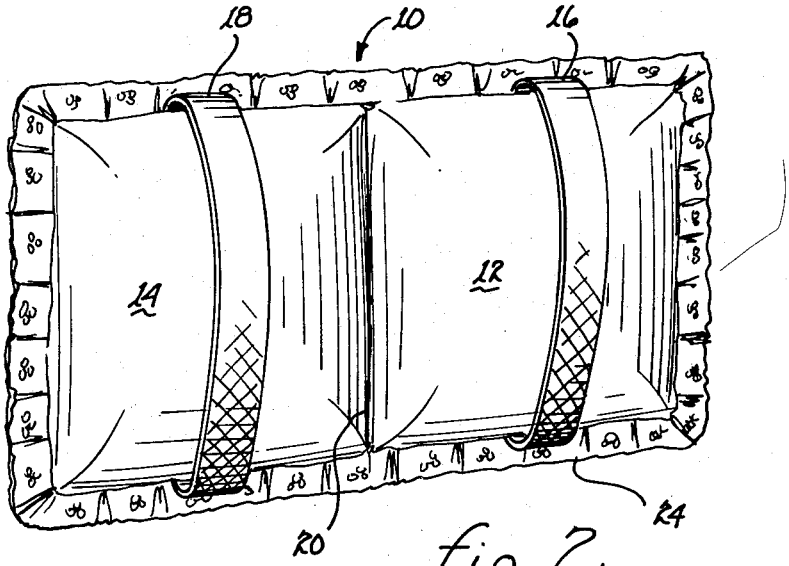
FIG. 2 is a bottom view of the subject invention.

Referring now to FIG. 2, a bottom view of the subject invention is shown illustrating the means by which the pair of pillows are held in position in the crook of the person's elbow. The holding means illustrated comprises a pair of elastic straps 16 and 18, elastic strap 16 attached to the perimeter seam 24 of opposite sides of pillow 12, and elastic strap 18 similarly attached to the similar sides of the perimeter seam 24 of pillow 14.

When it is desired to wear the elbow pillow 10 upon the person's arm, be it in the position at the elbow or at any other position, or for that matter, upon any limb of a person's body, the person slips their limb between the elastic straps and the respective pillows. The elbow pillow 10 is then pulled along the person's limb until the position desired for it to rest has been reached. With the elastic straps shown being of appropriate length for the particular limb to be encompassed, a secure holding orientation can be achieved of the elbow pillow upon the limb which will remain in place until removal by essentially reversing the same method is effected.

Figure 3:
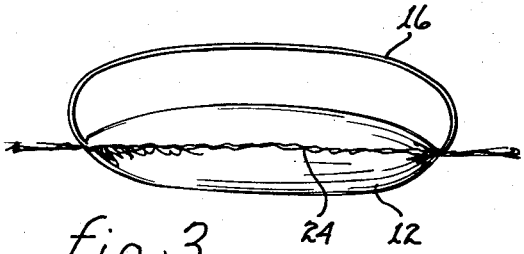
FIG. 3 is an end view of the subject invention.

Referring now to FIG. 3, an end view of the subject inventive elbow, and more specifically pillow 12, is shown in an upsidedown position. Detailed in FIG. 3 is the pillow 12 together with its elastic strap 16 attached on the pillow side seam. Also shown in FIG. 3 is perimeter seam 24 which is representative of the sew line which is used to join the upper and lower pieces of cloth or other material type, such as plastic or leather, used in constructing the elbow pillow.

In construction of the preferred embodiment, it is obvious that many methods may be utilized and the following is merely one of these methods. Firstly, the manufacturer takes two pieces of similarily sized material of a generally rectangular shape and proceeds to sew along three of the continuous edges to make the perimeter seam 24. Before the sewing is completed, two pieces of elastic straps are placed inside between the two pieces of material from side to side so that the ends of the elastic materials are in the sew line on opposite sides. The elastic materials are aligned transverse to the longest dimension of the piece of material. After the three sides are sewn, the manufacturer reaches interiorly to the then formed bag and pulls the end through the mouth such as to turn the bag inside-out, which in this case, merely places the edges formerly outside the sew line inside the now inside-out bag. It is noted that now the straps will be on the outside of the bag.

Next, two substantially identical wads of padding or whatever filler material is utilized, are placed interiorly to the bag, substantially one at each end of the bag. The padding material is then smoothed out substantially to the shape desired and the central seam 20 between the two bags is sewed. The last remaining sew line of perimeter 24 to be sewed is placed on the mouth of the bag after the periphery of the bag has been turned interiorly to the mouth of the bag. With that operation, the elbow pillow is now complete.

In addition, if desired, ornamentation in the form of lace or other decorative material may be placed around the peripheral seam 24 of the elbow pillow.

Figure 4:
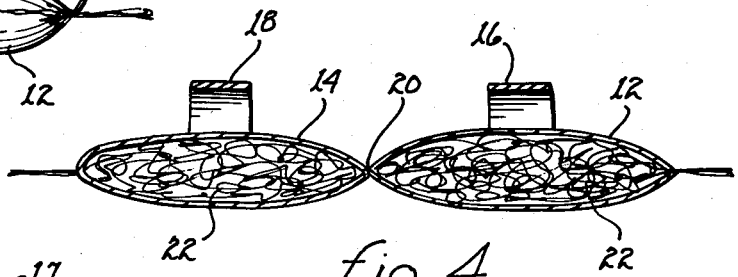
FIG. 4 is a longitudinal cross-sectional view of the subject invention.

Referring now to FIG. 4, a longitudinal cross-sectional view of the subject invention is shown. Both pillows 12 and 14 have been opened in this cross-sectional view revealing the padding or stuffing 22 mutually interiorly to them. Rising above the pillows 12 and 14 are elastic straps 16 and 18 respectively. Central to the two pillows is seam line 20 which joins the pillows together and provides the line about which the pillows may fold. As indicated earlier, stuffing or padding 22 may be made out of most any soft, compressible material such as cotton, wool, or the popularily available non-allergetic synthetic fiber materials popularily used in bed-type pillows and the like.

Figure 5:
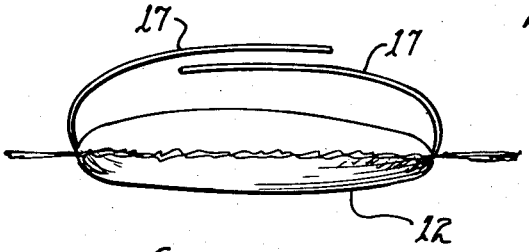
FIG. 5 is an end view of an alternate embodiment of the subject invention.

Referring now to FIG. 5, an alternate embodiment of the subject invention is shown, here an end view of the elbow pillow similar to that illustrated in FIG. 3. The modification which has been made to the preferred embodiment is to substitute for elastic strap 16 a new strapping means, namely two straps 17 attached at opposite sides made of the commercially available VELCRO material which has the characteristic of holding together when pressed together. Here the VELCRO treated side of each strap is such that as the upper strap encompasses the lower strap, the VELCRO connection is initiated. It is obvious that utilization of the two velcro straps 17 as shown in FIG. 5 provide even faster placement and removal of the inventive pillow upon the limbs of a person.

As is obvious to the reader, the subject elbow pillow provides a convenient and comfortable means by which to cradle a baby, or other type object in a person's arm where both comfort is given to the baby or to the person wearing the elbow pillow.

It is equally obvious to the reader that many modifications of the subject pillow may be made, such that the subject elbow pillow could be one continuous pillow and not divided into two pillows as shown in the preferred embodiment; that the pillow could be of any shape and not merely a rectangle, i.e., it could be triangular in shape; and that any number of elastic straps could be utilized from a single strap to a plurality of straps.

While a preferring embodiment of the subject invention has been shown and described, it will be appreciated that other embodiments are readily apparent and that the subject invention is not to be limited except in accordance with the appended claims.

I claim:

1. Apparatus for distributing loads in the crook of a user's arm to avoid impeding blood circulation on placement of a load at the crook of the arm and without restricting elbow movement, said apparatus comprising in combination:

(a) a first sheet of flexible material;

(b) a second sheet of flexible material;

(c) stuffing disposed intermediate said first and second sheets of material, said stuffing being divided into two segregated divisions;

(d) means extending about the perimeter of said first and second sheets of material for enclosing the two divisions of said stuffing therebetween;

(e) means for securing said first and second sheets of material against one another intermediate the divisions of said stuffing and transverse to said apparatus to form two parts of said apparatus flexibly juxtaposed with one another by said two sheets of material;

(f) first strap means attached to one of the parts of said apparatus for encircling the user's forearm; and (g) second strap means attached to another of the parts of said apparatus for encircling the user's upper arm, said first and second strap means operating in concert to maintain continuingly during use of said apparatus and securing means positionally coincident with the crook of the arm to permit flexing of said apparatus commensurate with bending of the arm;

whereby, said apparatus is retainable adjacent the crook of a user's arm by said first and second straps to cushion the crook of the arm and distribute any loads placed thereon and without impeding blood circulation or restricting elbow movement.

2. The apparatus as set forth in claim 1 wherein said first sheet of material is formed of two pieces of material joined by said securing means.

3. The apparatus as set forth in claim 1 wherein said second sheet of material is formed of two pieces of material joined by said securing means.

4. The apparatus as set forth in claim 3 wherein said first sheet of material is formed of two pieces of material joined by said securing means.

5. The apparatus as set forth in claim 1 including lace attached to the perimeter of said first and second sheets of material.

* * * * *